US008128079B2

(12) United States Patent
Hsu

(10) Patent No.: US 8,128,079 B2
(45) Date of Patent: Mar. 6, 2012

(54) WEB PRODUCT FOLDING AND STACKING MACHINE, AND WEB PRODUCT FOLDING AND STACKING METHOD USING THE MACHINE

(75) Inventor: Huang-Pin Hsu, Taoyuan (TW)

(73) Assignee: Chan Li Machinery Co., Ltd., Taoyuan (TW)

( * ) Notice: Subject to any disclaimer, the term of this patent is extended or adjusted under 35 U.S.C. 154(b) by 209 days.

(21) Appl. No.: 12/640,922

(22) Filed: Dec. 17, 2009

(65) Prior Publication Data

US 2011/0068527 A1 Mar. 24, 2011

(30) Foreign Application Priority Data

Sep. 21, 2009 (TW) ..... 98131792 A

(51) Int. Cl.
*B41L 1/32* (2006.01)
*B31F 1/08* (2006.01)

(52) U.S. Cl. ..... 270/39.02; 270/39.01; 270/39.05

(58) Field of Classification Search ..... 270/32, 270/39.01, 39.02, 39.05, 40, 41; 493/413, 493/418, 424, 430, 433, 451
See application file for complete search history.

(56) References Cited

U.S. PATENT DOCUMENTS

| | | | | |
|---|---|---|---|---|
| 4,566,834 | A | 1/1986 | Baba et al. | |
| 4,770,402 | A | 9/1988 | Couturier | |
| 4,874,158 | A * | 10/1989 | Retzloff | 270/39.02 |
| 5,088,707 | A * | 2/1992 | Stemmler | 270/39.02 |
| 5,730,695 | A * | 3/1998 | Hauschild et al. | 493/416 |
| 5,996,987 | A | 12/1999 | Leu et al. | |
| 2004/0126172 | A1 * | 7/2004 | Matteis | 400/578 |

FOREIGN PATENT DOCUMENTS

| | | |
|---|---|---|
| EP | 0 865 918 A1 | 9/1998 |
| EP | 1 415 945 A1 | 5/2004 |
| JP | 1984-46953 | 3/1984 |
| JP | 07-053122 | 2/1995 |
| JP | 10-194457 | 7/1998 |

* cited by examiner

*Primary Examiner* — Leslie A Nicholson, III
(74) *Attorney, Agent, or Firm* — Muncy, Geissler, Olds & Lowe, PLLC

(57) ABSTRACT

A web product folding and stacking machine includes two folding line making rolls, two folding fingers, a first carrier unit, a stoppage unit and a holder. The folding line making rolls and the folding fingers are operated to fold up web products on a pad on the first carrier unit to form a stack of interfolded web products. When a stack of a predetermined number of interfolded web products is finished, the stoppage unit is extended out to have the finished stack of interfolded web products be carried with the holder and the stoppage unit to a predetermined location for delivery. Subject to the effect of the pad on the first carrier unit, web products are effectively folded up and stacked in a neat status.

21 Claims, 13 Drawing Sheets

WEB PRODUCT FOLDING AND STACKING MACHINE, AND WEB PRODUCT FOLDING AND STACKING METHOD USING THE MACHINE

BACKGROUND OF THE INVENTION

The present invention is related to a folding machine and more particularly to a web product folding and stacking machine, which is practical for making a stack of interfolded web products.

Please refer to FIG. 1. A conventional web product folding and stacking machine 10 is shown comprising two folding line making rolls 11, two folding fingers 13, a first carrier unit 15, a stoppage unit 17 and a holder 19. The two folding line making rolls 11 are rotatable in reversed directions to cause each fed web product 12 to form a folding line. The folding fingers 13 are adapted to stack up folded web product s 12 on the first carrier unit 15.

If the stacked web products 12 surpasses a predetermined quantity, the stacked web product 12 will be deformed during contact between the folding fingers 13 and the newly fed web product 12, thereby extending the contact time between the folding fingers 13 and the newly fed web product 12, for example, the stacked web product 12 will sink due to the effect of the folding fingers 13. However, if only a limited number of web products 12 has been stacked on the first carrier unit 15, for example, during the initial stage of the stacking operation of the folding fingers 13 to stack up web products 12 on the first carrier unit 15, the contact time between the folding fingers 13 and the newly fed web product 12 will be short, due to the non-deformable characteristic of the first carrier unit 15, resulting in poor alignment of the stacked web product 12 on the first carrier unit 15.

The stoppage unit 17 is adapted to isolate a finished stack of interfolded web products 12. For example, when a predetermined number of web products 12 are interfolded into a stack, the stoppage unit 17 extends out to stop at the top side of the stack of interfolded web products 12. After extension of the stoppage unit 17 to deliver the finished stack of interfolded web products 12 with the holder 19, one web product 121 will suspend from the first carrier unit 15. When the holder 19 holds a stack of interfolded web products 12 from the first carrier unit 15, the holder 19 will push the suspending web product 121, causing the suspending web product 121 unable to be rested on the holder 19 accurately in position, resulting in unkempt stack of interfolded web products 12.

SUMMARY OF THE PRESENT INVENTION

It is, therefore, the main object of the present invention to provide a web product folding and stacking machine, which has a pad arranged on the top surface of a first carrier unit so that folding fingers can fold and stack web products on the first carrier unit accurately as only a limited number of web products has been stacked on the first carrier unit, making a neat stack of interfolded web products.

It is another object of the present invention to provide a web product folding and stacking machine, which has a suction device mounted in the first carrier unit for sucking one web product suspending from the first carrier unit to have the web product be positively secured to the bottom surface of the first carrier unit.

It is still another object of the present invention to provide a web product folding and stacking machine, which uses a suction device to suck one web product been folded by the first folding unit and the second folding unit, having the folded web product be positively secured to the bottom surface of the first carrier unit.

It is still another object of the present invention to provide a web product folding and stacking machine, which has a flexible pad arranged on the top surface of the first carrier unit to impart an upward pressure to the web products stacked thereon so as to extend the contact time between the folding fingers and the stacked folded web products, facilitating making of a neat stack of interfolded web products.

To achieve these and other objects of the present invention, a web product folding and stacking machine, comprising: two folding line making rolls arranged in proximity to each other for transferring web products and causing each the web product to form a folding line thereon; two folding fingers adapted to fold up each the web products along the folding line thereof for enabling the web products to be stacked up in an interfolded condition; a first carrier unit, the first carrier unit having a top surface and a bottom surface opposite to the top surface; a pad arranged on the top surface of the first carrier unit for carrying the web product for folding by the folding fingers; a stoppage unit adapted to isolate interfolded web products, the stoppage unit being movable in a first direction; and a holder adapted to hold interfolded web products, the holder being movable in the first direction.

To achieve these and other objects of the present invention, a web product folding and stacking machine, comprising: two folding line making rolls arranged in proximity to each other for transferring web products and causing each the web product to form a folding line thereon; two folding fingers adapted to fold up each the web products along the folding line thereof for enabling the web products to be stacked up in an interfolded condition; a first carrier unit adapted to carry the web product folded by the folding fingers; a suction device installed in the first carrier unit and adapted to suck the web product suspending from the first carrier unit; a stoppage unit adapted to isolate interfolded web products, the stoppage unit being movable in a first direction; and a holder adapted to hold interfolded web products, the holder being movable in the first direction.

The invention further provides a web product folding and stacking method used in the web product folding and stacking machine. The method includes the steps of: forming a folding line on each of a plurality of web products and folding each the web product on the first carrier unit immediately after formation of the folding line; operating the suction device to suck the web product suspending from the first carrier unit; operating the stoppage unit to isolate interfolded web products when the number of the interfolded web products reaches a predetermined quantity; and moving the stoppage unit and the holder and the interfolded web products held thereon to a predetermined location.

DETAILED DESCRIPTION OF THE PREFERRED EMBODIMENTS

Figure 1:
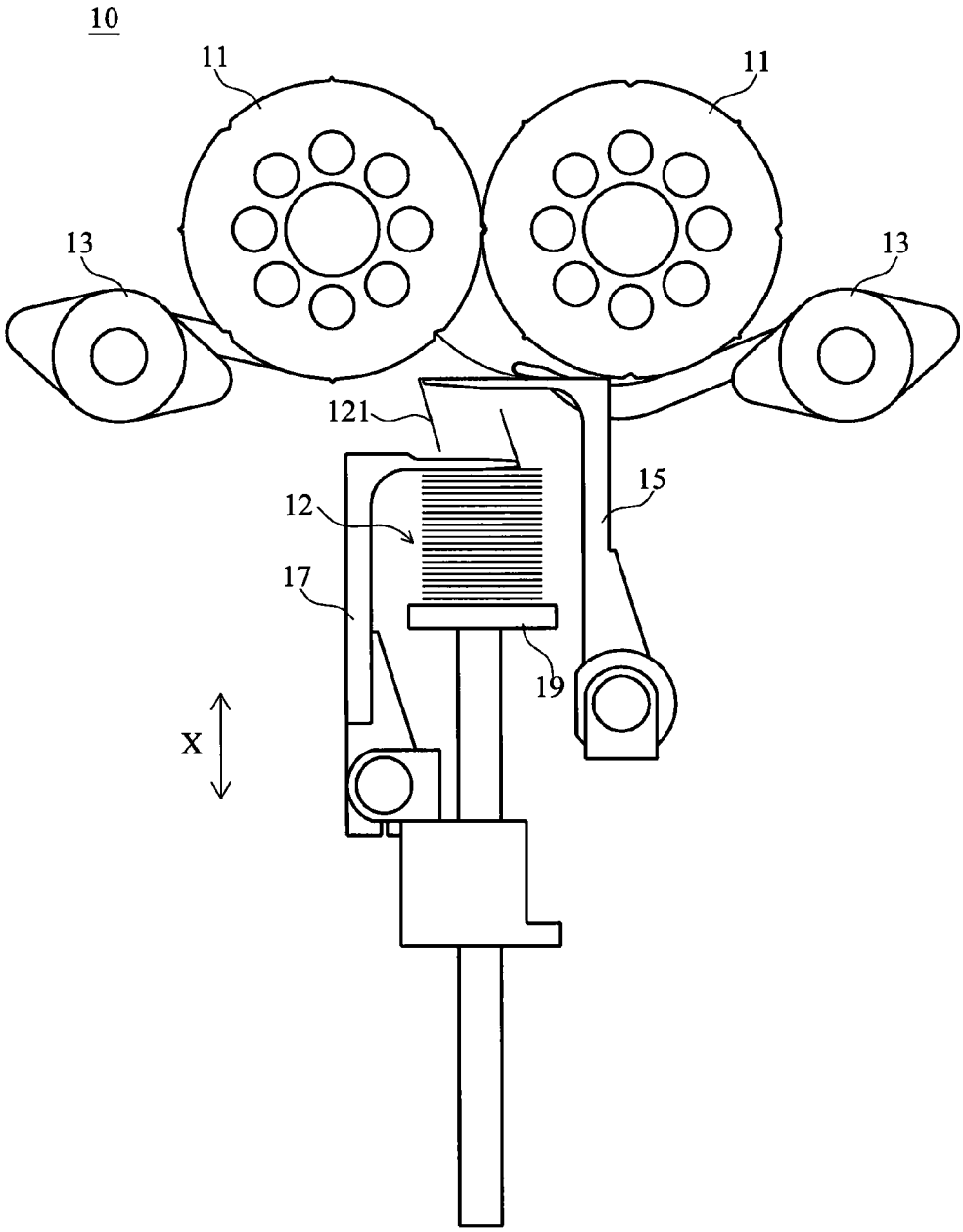
FIG.1 (PRIOR ART)
FIG. 1 is a schematic structural view of a web product folding and stacking machine according to the prior art.
Figure 2:
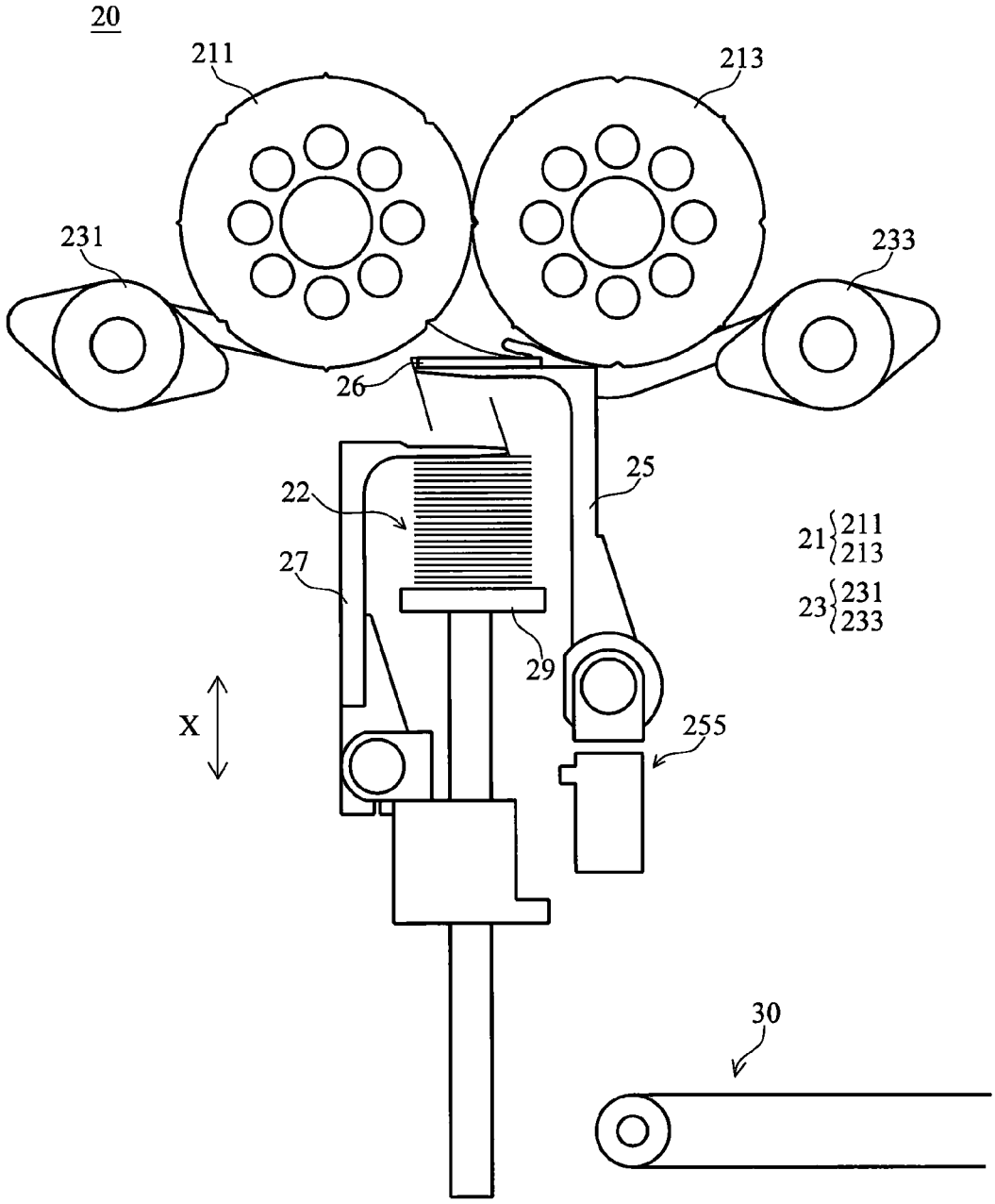
FIG. 2 is a schematic structural view of a web product folding and stacking machine in accordance with the present invention

Please refer to FIG. 2. A web product folding and stacking machine 20 in accordance with the present invention is shown comprising two folding line making rolls 21, two folding fingers 23, a first carrier unit 25, a stoppage unit 27 and a holder 29. Subject to the use of the web product folding and stacking machine 20, web products 22 can be folded and stacked up neatly.

The two folding line making rolls 21 are rotatable in two reversed directions to cause each transferring web product 22 to form a folding line for folding and stacking. According to the present preferred embodiment, the first carrier unit 25 has a pad 26 arranged on the top surface 251 thereof for carrying interfolded web products 22 in a stack. Further, when the thickness of interfolded web products 22 reaches a certain extent, the first carrier unit 25 will be lowered slowly in a first direction X.

The pad 26 is made from an elastic material. For example, the pad 26 can be made from rubber, silicon rubber, sponge, paper sheet or cloth that is capable of imparting an upward return force F to the web product 22 and/or the folding fingers 23 during downward stroke of the folding fingers 23, thereby extending the contact time between the folding fingers 23 and the respective web product 22 and facilitating accurate stacking of the interfolded web products 22.

Figure 2A:
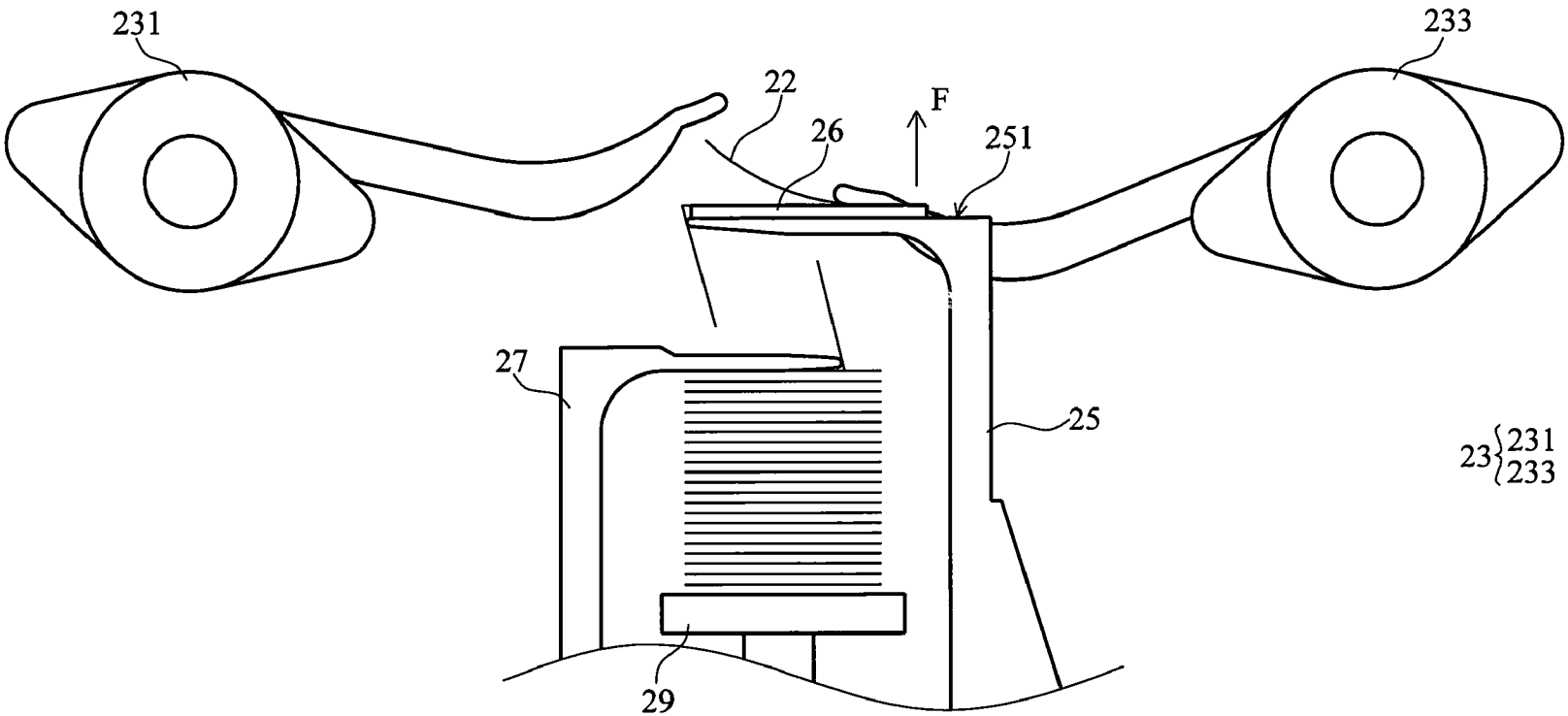
FIG. 2A is a schematic enlarged partial view of the web product folding and stacking machine in accordance with the present invention (I).

During the stage where only a limited number of web products 22 have been folded and stacked together, the deformable characteristic of the pad 26 extends the contact time between the folding fingers 23 and the web product 22 under folding, for example, when the folding fingers 23 are acting upon the web product 22, the folding fingers 23 impart a downward pressure through the web product 22 to the pad 26, causing the pad 26 to sink. When the folding fingers 23 release the pressure from the pad 26, the pad 26 will immediately return to its former shape, thereby extending the contact time between the folding fingers 23 and the respective web product 22, as shown in FIG. 2A. Therefore, web products 22 can be accurately folded up in an interfolded stack in a neat status, eliminating the problems of the prior art technique such as poor alignment of the interfolded web products 22 during the initial stacking stage.

The two folding line making rolls 21 include a first folding line making roll 211 and a second folding line making roll 213. The first folding line making roll 211 has a plurality of longitudinal protrusions 2111 and a plurality of longitudinal grooves 2113 alternatively arranged around the periphery thereof. Similar to the first folding line making roll 211, the second folding line making roll 213 has a plurality of longitudinal protrusions 2131 and a plurality of longitudinal grooves 2133 respectively alternatively arranged around the periphery thereof.

The first folding line making roll 211 and the second folding line making roll 213 are arranged in a parallel manner in proximity to each other such that the longitudinal protrusions 2111 of the first folding line making roll 211 can be engaged into the longitudinal grooves 2133 of the second folding line making roll 213; the longitudinal protrusions 2131 of second folding line making roll 213 can be engaged into the longitudinal grooves 2113 of the first folding line making roll 211.

Figure 2B:
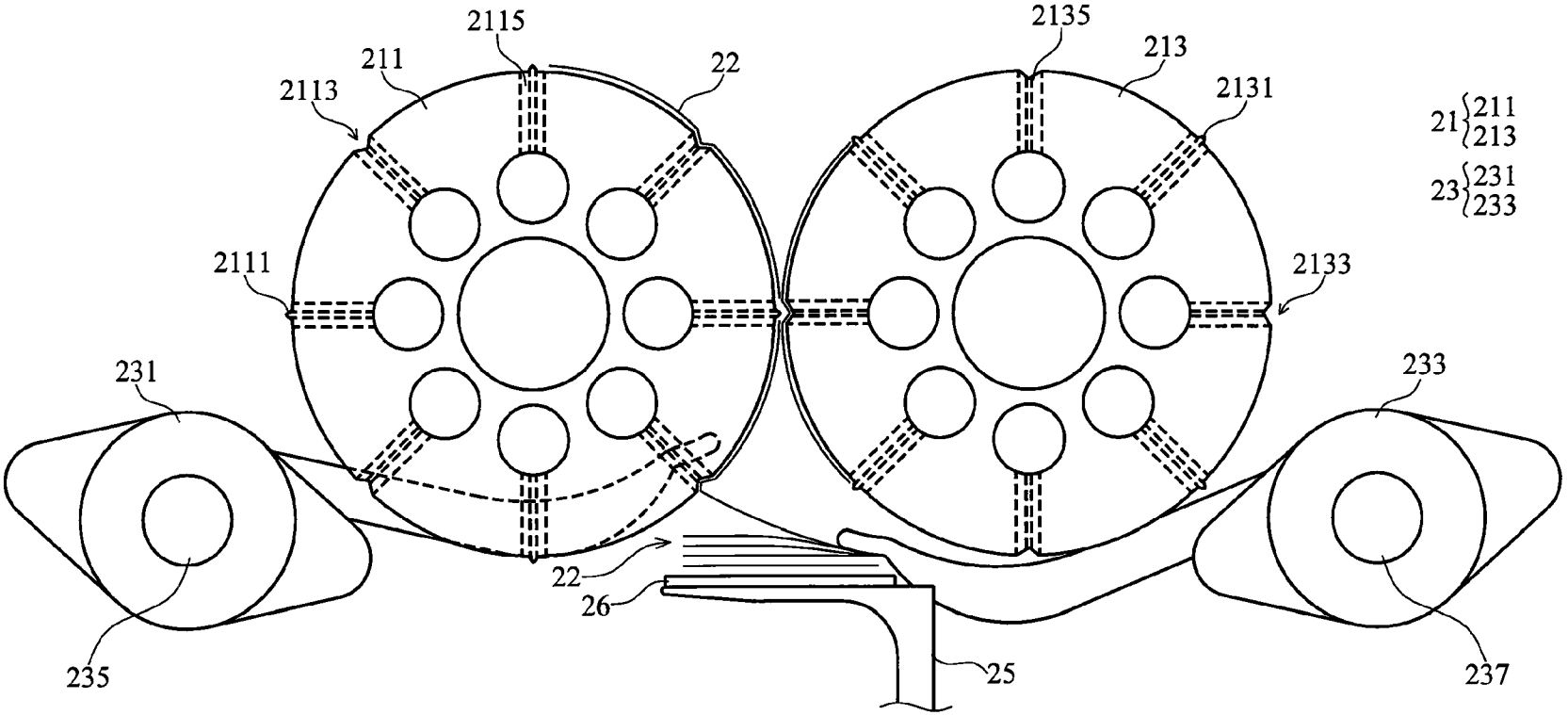
FIG. 2B is a schematic enlarged partial view of the web product folding and stacking machine in accordance with the present invention (II).

The first folding line making roll 211 and the second folding line making roll 213 are rotatable in reversed directions, for example, the first folding line making roll 211 is rotatable in clockwise direction and the second folding line making roll 213 is rotatable in counter-clockwise direction. When one web product 22 is being transferred through the gap in between the first folding line making roll 211 and the second folding line making roll 213 during rotation of the first folding line making roll 211 and the second folding line making roll 213 in two reversed directions, the web product 22 will be squeezed by one longitudinal protrusion 2111 or 2131 of the first folding line making roll 211 or second folding line making roll 213 and one corresponding longitudinal groove 2133 or 2113 of the second folding line making roll 213 or first folding line making roll 211, thereby causing formation of a folding line on the web product 22, as shown in FIG. 2B.

Suction holes 2115 and 2135 are respectively formed in the first folding line making roll 211 and the second folding line making roll 213 corresponding to the respective longitudinal protrusions 2111 and 2131 and the respective longitudinal grooves 2133 and 2113 for sucking in air such that the folding line making rolls 21 can suck or release the web product 22. Further, the folding fingers 23 include a first folding finger 231 and a second folding finger 233 respectively pivotally supported on a respective pivot member 235 or 237 at a lower elevation relative to the folding line making rolls 21. Thus, the first folding finger 231 and the second folding finger 233 can be turned about the respective pivot member 235 or 237 within a predetermined angle to fold the web product 22 along its folding line.

The folding line making rolls 21 are to form a folding line along the central axis of each web product 22 being transferred. The folding fingers 23 are adapted to fold up each web product 22 along the folding line and to stack up the folded web products 22 in an interfolded status neatly. Further, the web products 22 can be toilet paper, facial tissues, paper towels, wet tissues or the like. Thus, a predetermined number of interfolded web products 22 can be packed in a commercial pop-up tissue box.

The stoppage unit 27 is adapted to separate interfolded web products 22. In actual application, the amount of interfolded web products 22 can be known subject to the number of operation cycles of the folding fingers 23. When the number of interfolded web products 22 reaches the set value, the stoppage unit 27 is extended out to isolate the interfolded web products 22. The holder 29 is adapted to hold the interfolded web products 22 and to match with the stoppage unit 27 for enabling the interfolded web products 22 to be delivered to a predetermined location.

In one embodiment of the present invention, the stoppage unit 27 is connected to the holder 29 and movable with the holder 29 in the first direction X to a predetermined location, for example, the stoppage unit 27 and the holder 29 can be moved to carry the interfolded web products 22 to a conveyer 30. The web product folding and stacking machine 20 further comprises at least one air blower unit 255 controllable to blow air toward the part of the last piece of the interfolded web products 22 outside the stoppage unit 27, causing the last web product 22 to be folded on the stoppage unit 27. The air blower unit 255 can be, for example, arranged below the first carrier unit 25.

Figure 3A:
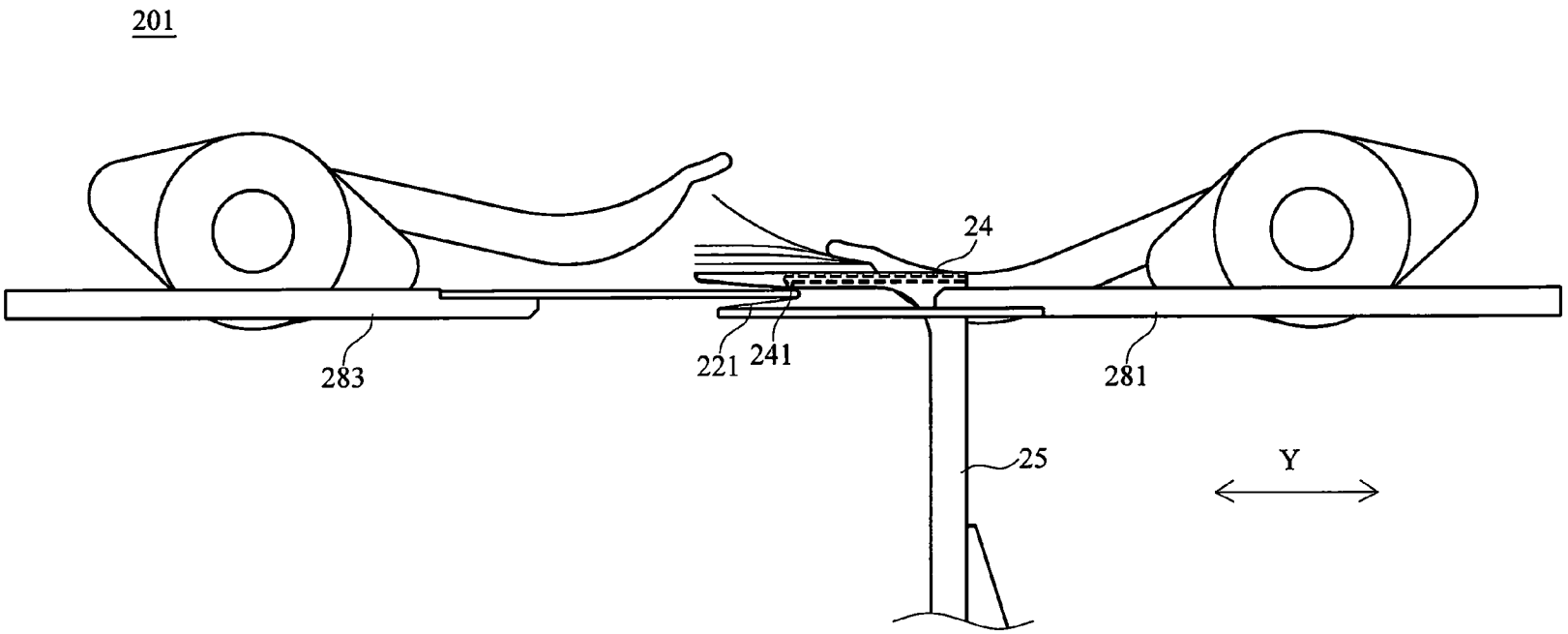
FIG. 3A is a schematic enlarged partial view of an alternate form of the web product folding and stacking machine in accordance with the present invention (I).
Figure 3B:
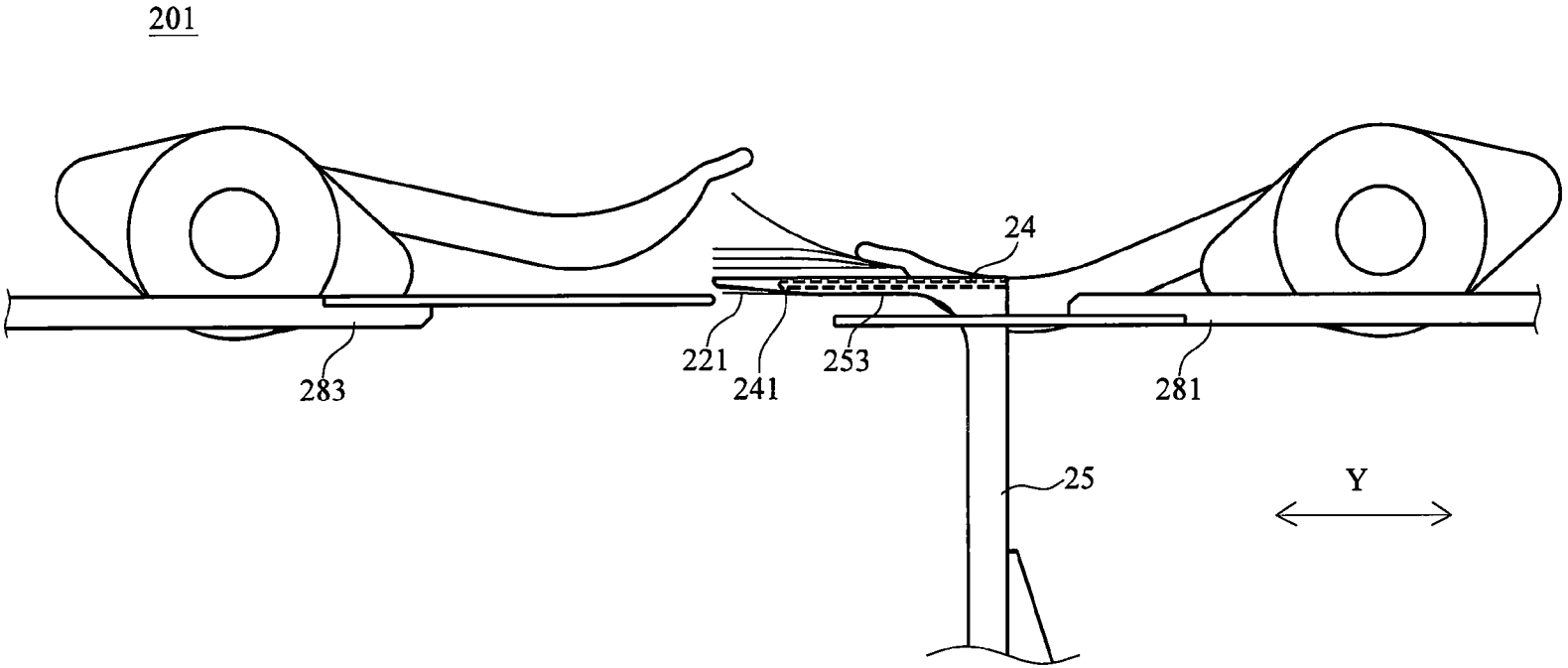
FIG. 3B is a schematic enlarged partial view of the alternate form of the web product folding and stacking machine in accordance with the present invention (II).

FIG. 3A and FIG. 3B show an alternate form of the web product folding and stacking machine 201 in accordance with the present invention. According to this alternate form, the web product folding and stacking machine 201 further comprises a suction device 24 arranged on the first carrier unit 25. The suction device 24 has a nozzle hole 241 located on the bottom surface 253 of the first carrier unit 25 for sucking in or exhausting air, thereby securing a web product 221.

The web product folding and stacking machine 201 comprises a first folding unit 281 and a second folding unit 283 adapted to fold up the web product 221 suspending from the first carrier unit 25. The first folding unit 281 and the second folding unit 283 can be arranged at different elevations. An overlap region is formed when the first folding unit 281 and the second folding unit 283 are been moved toward each other in a second direction Y perpendicular to the first direction X, thereby folding up the web product 221 suspending from the first carrier unit 25, as shown in FIG. 3A.

The suction device 24 is arranged on the first carrier unit 25. When the first folding unit 281 and the second folding unit 283 are been moved apart, the suction device 24 sucks the folded web product 221, thereby securing the folded web product 221 to the bottom surface 253 of the first carrier unit 25, as shown in FIG. 3B. Thus, the invention effectively eliminates the non-alignment problem of the web product 121 suspending from the first carrier unit 15. Further, the holder 29 (see also FIG. 2) is holding folded web products 22, the web product 221 that is secured to the bottom surface 253 of the first carrier unit 25 can be accurately folded up and stacked on the holder 29.

Normally, the first folding unit 281 and the second folding unit 283 are controlled to fold up each web product 22 at one quarter from the edge, and the user can conveniently pup up the first (top) piece of a stack of interfolded web products.

Figure 4A:
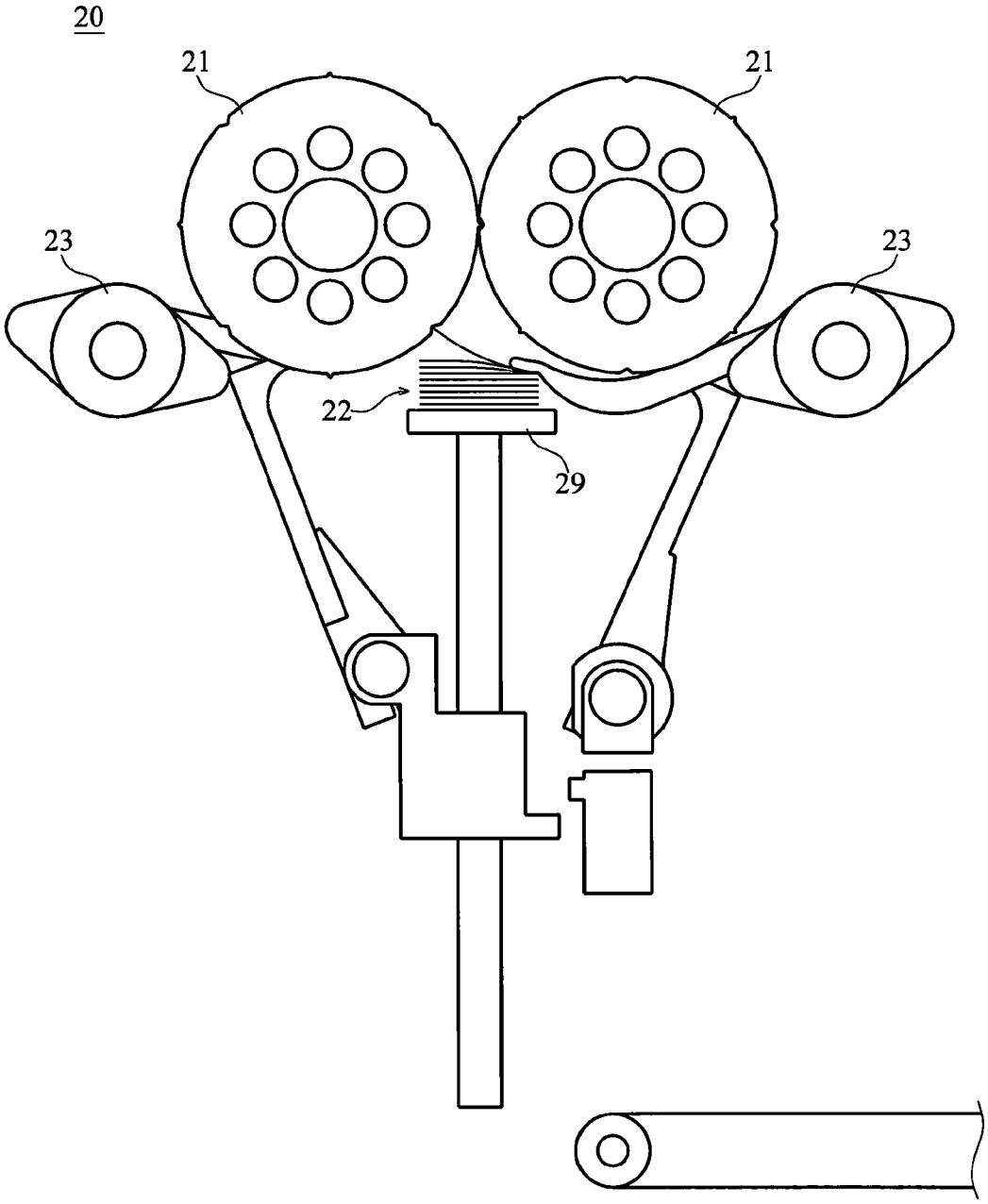
FIGS. 4A~4G illustrate the operation flow of the web product folding and stacking machine in accordance with the present invention.

FIGS. 4A through 4G illustrate the operation of the web product folding and stacking machine 20. When the web product folding and stacking machine 20 is started, the holder 29 is moved to a predetermined position, and then the folding line making rolls 21 and the folding fingers 23 are operated to fold web products 22 into a stack of interfolded web products 22 on the holder 29, as shown in FIG. 4A.

When the number of the interfolded web products 22 on the holder 29 reaches a predetermined quantity, the stoppage unit 27 is extended out to isolate the interfolded web products 22, and then the stoppage unit 27 is moved with the interfolded web products 22 and the holder 29 in the first direction X to a predetermined location for delivery.

Figure 4B:
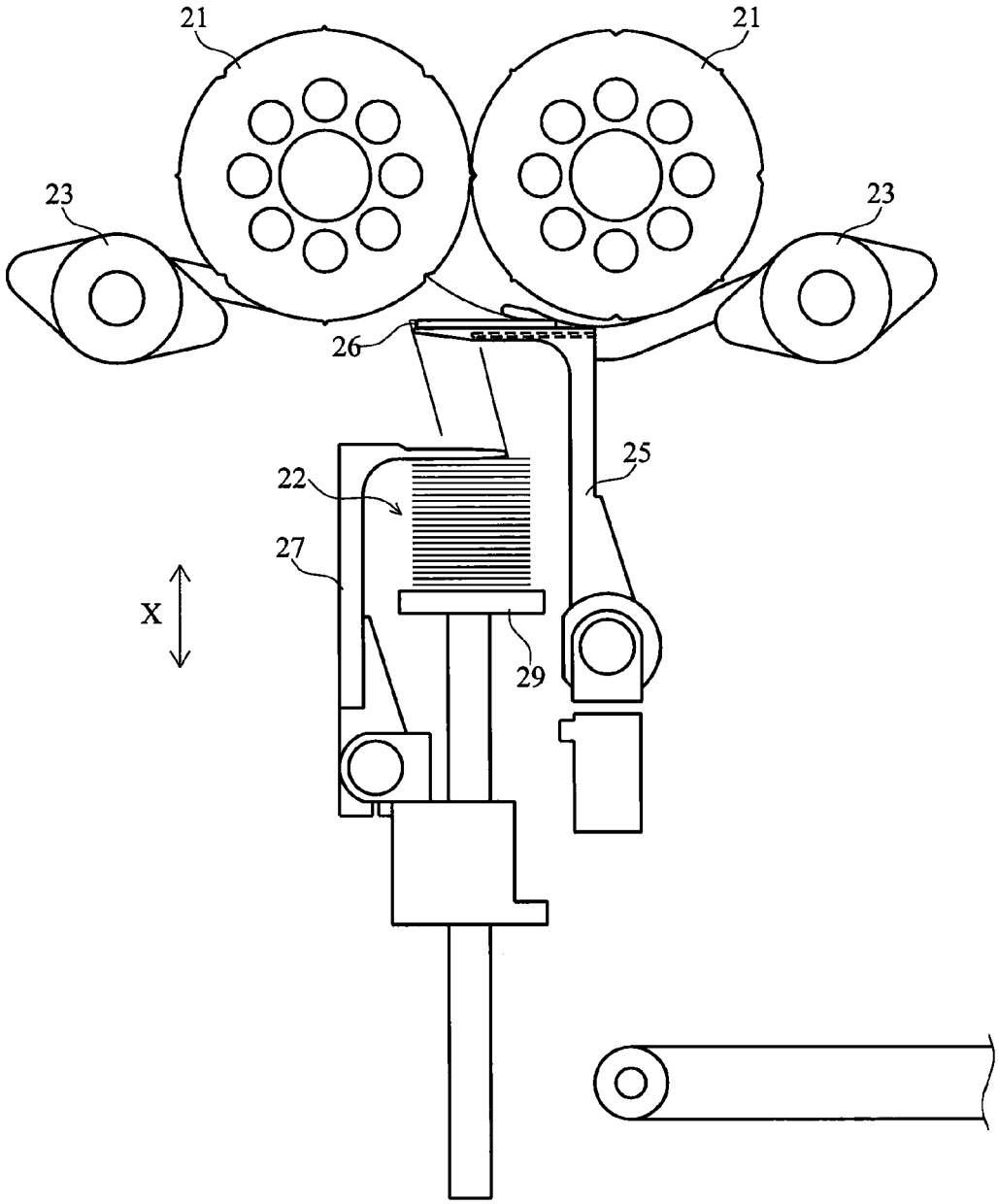

Further, when the stoppage unit 27 is extended out, the first carrier unit 25 is simultaneously extended out. The first carrier unit 25 has the pad 26 mounted thereon. The folding line making rolls 21 and the folding fingers 23 can continuously fold up web products 22 on the pad 26 at the first carrier unit 25 after finish of one stack of interfolded web products 22 on the holder 29, as shown in FIG. 4B.

Furthermore, because the pad 26 is arranged on the first carrier unit 25 at the top side and has an elastically deformable characteristic, when only a limited number of web products 22 has been stacked up on the pad 26, the pad 26 can impart an upward return force F through the web products 22 to the folding fingers 23 (see FIG. 2B), thereby effectively extending the contact time between the folding fingers 23 and the web products 22, facilitating making of a neat stack of interfolded web products 22.

Figure 4C:
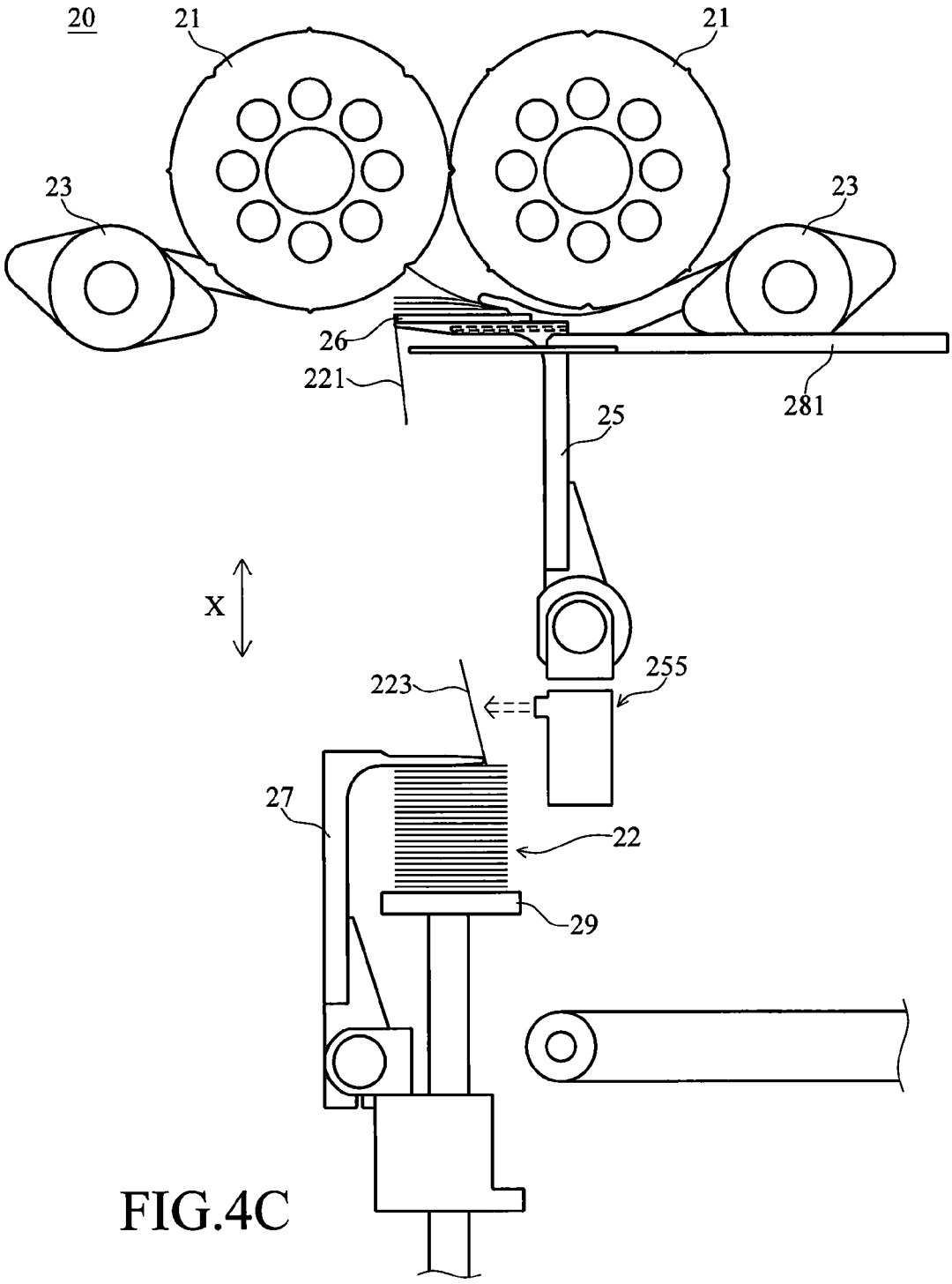

During delivery of the finished stack of interfolded web products 22 by the stoppage unit 27 and the holder 29 in the first direction X, the finished stack of interfolded web products 22 is separated from the first carrier unit 25, and one web product 221 will suspend from the first carrier unit 25. At the same time, the first (top) web product 223 of the finished stack of interfolded web products 22 partially is formed on the stoppage unit 27. The folding line making rolls 21 and the folding fingers 23 keep operating to make another stack of interfolded web products 22. Following increasing of the thickness of the interfolded web products 22 being stacked on the first carrier unit 25, the first carrier unit 25 will be lowered along the first direction X, and the first folding unit 281 that is arranged below the first carrier unit 25 will be extended out slowly. The web product folding and stacking machine 20 further comprises an air blower unit 255 adapted to blow air toward the first (top) web product 223 of the finished stack of interfolded web products 22, enabling the first (top) web product 223 to be folded on the stoppage unit 27, as shown in FIG. 4C.

Figure 4D:
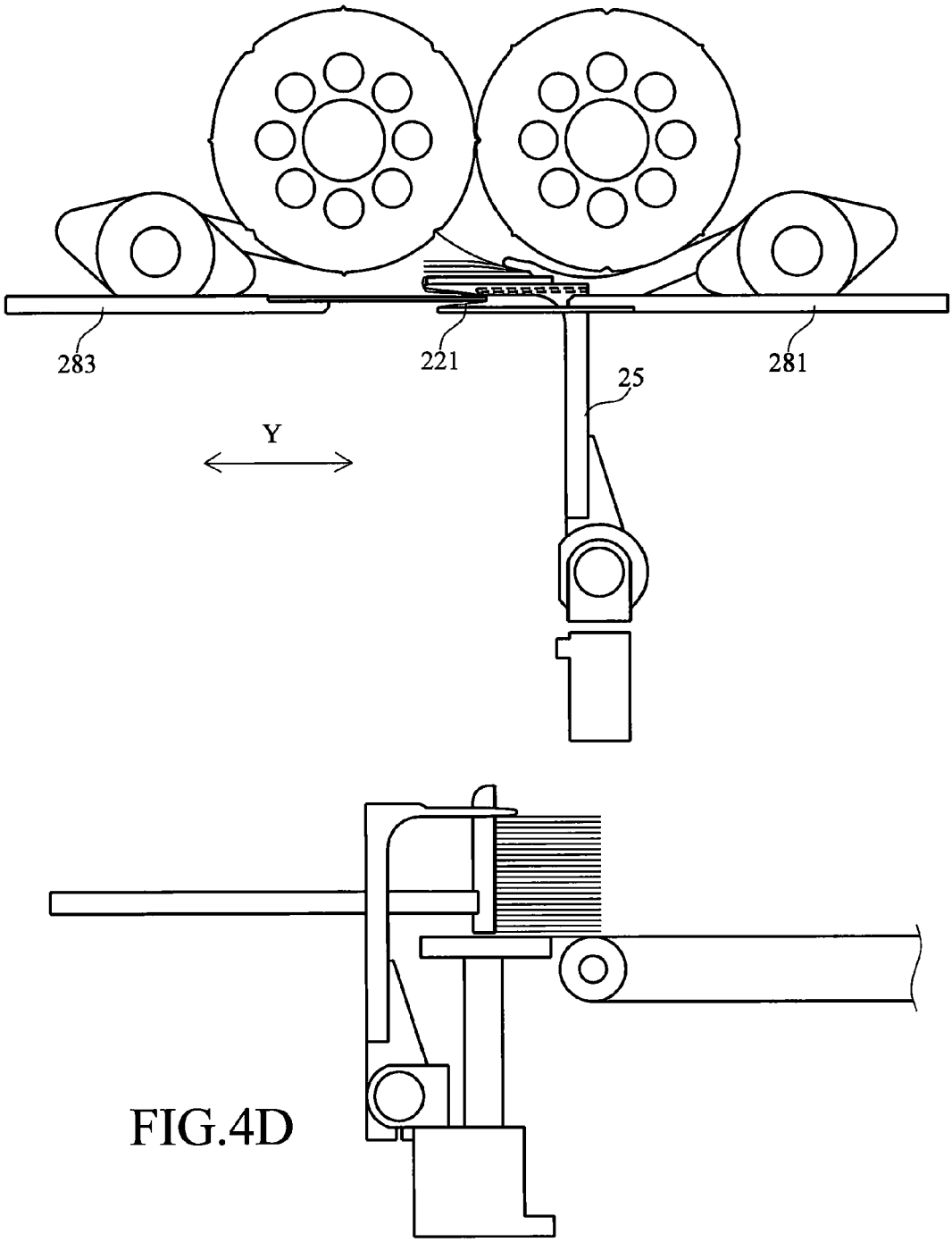

After extension of the first folding unit 281, the second folding unit 283 which is disposed between the first carrier unit 25 and the first folding unit 281 is extended out. The first folding unit 281 and the second folding unit 283 are movable in the second direction Y that is perpendicular to the first direction X. When the second folding unit 283 and the first folding unit 281 are overlapped, the second folding unit 283 and the first folding unit 281 can fold the web product 221 suspending from the first carrier unit 25. The extending order of the first folding unit 281 and the second folding unit 283 may be changed, or both the first folding unit 281 and the second folding unit 283 can be extended out at the same time, as shown in FIG. 4D.

Figure 4E:
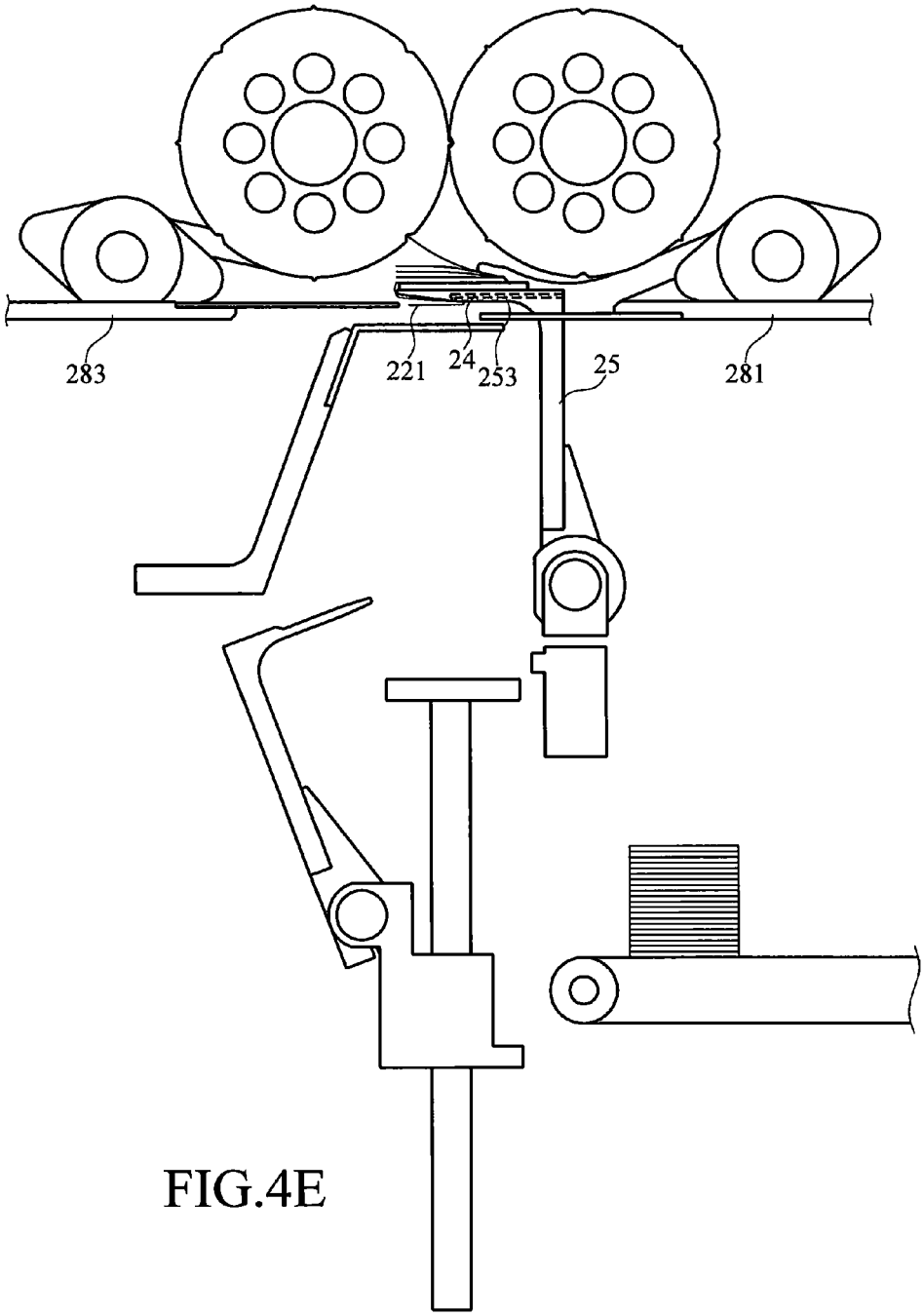
Figure 4F:
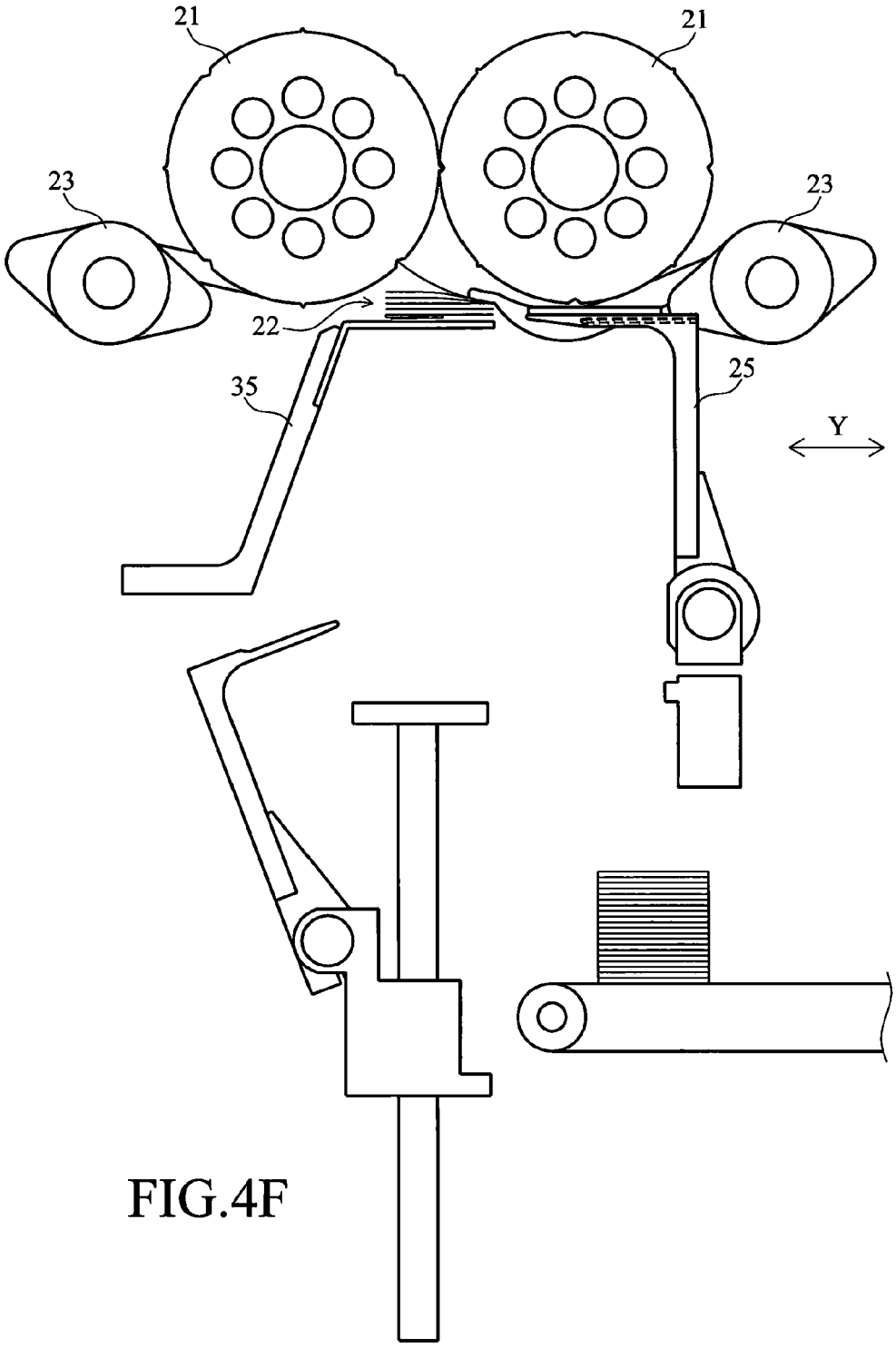

After folding of the web product 221, the first folding unit 281 and the second folding unit 283 are retracted gradually. At this time, the suction device 24 at the first carrier unit 25 is operated to suck the folded web product 221, causing the folded web product 221 to be adhered to the bottom surface 253 of the first carrier unit 25, as shown in FIG. 4E. In one embodiment of the present invention, the web product folding and stacking machine 20 further comprises a second carrier unit 35 adapted to receive the stack of interfolded web products 22 from the first carrier unit 25. The second carrier unit 35 can be extended out along, for example, the second direction Y, and the first carrier unit 25 will be retracted when the second carrier unit 35 is extended out, enabling the stack of interfolded web products 22 to be placed on the second carrier unit 35. When the stack of interfolded web products 22 is shifted from the first carrier unit 25 to the second carrier unit 35, the folding line making rolls 21 and the folding fingers 23 keep operating. Following increasing of the number of interfolded web products 22, the second carrier unit 35 is lowered along the first direction X, as shown in FIG. 4F.

Figure 4G:
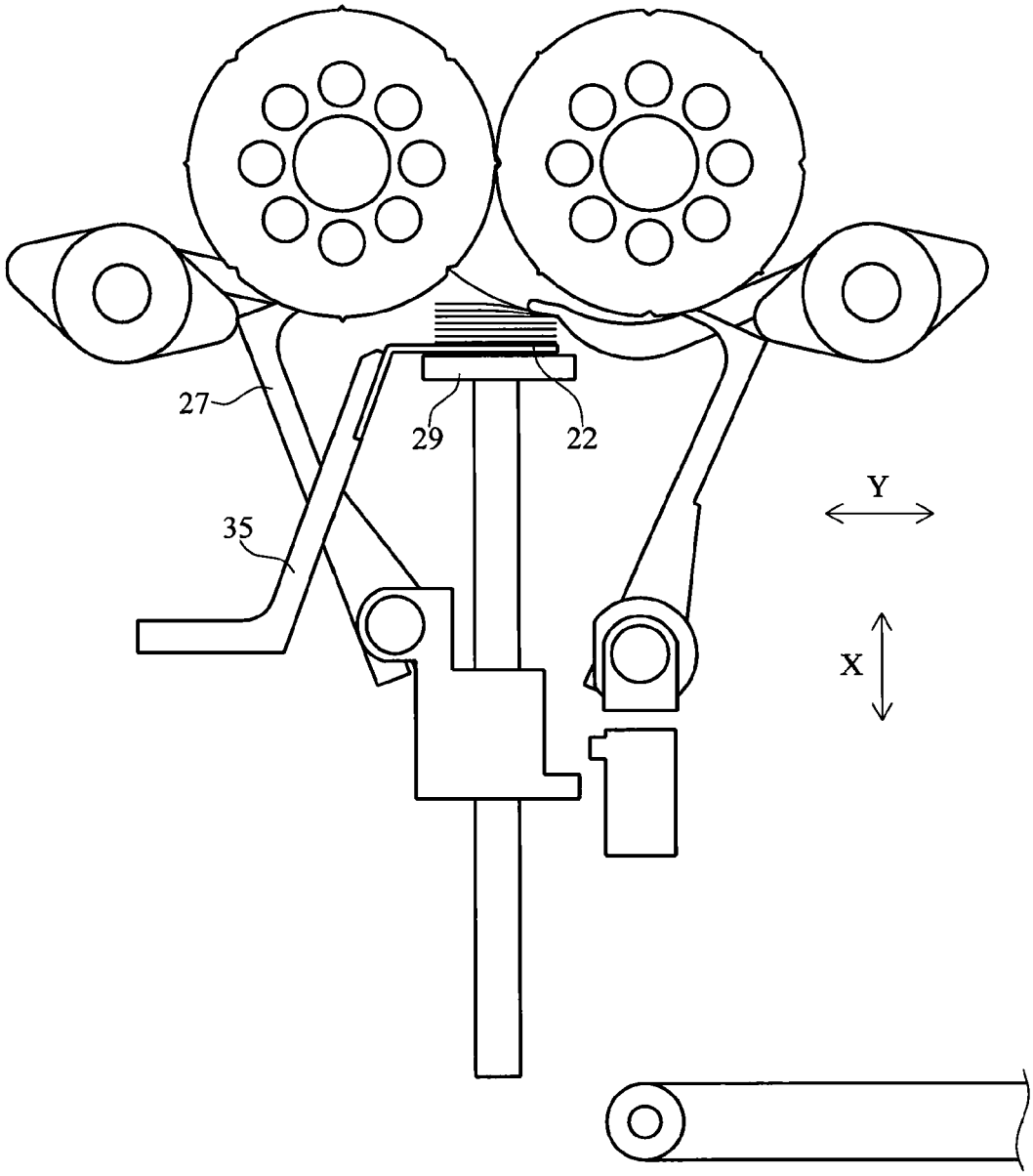

After delivery of one finished stack of interfolded web products 22 to the assigned location, the stoppage unit 27 and the holder 29 are moved upwards along the first direction X. When the holder 29 reaches the set position, the second carrier unit 35 is retracted along the second direction Y, enabling the holder 29 to receive folded web products 22 from the second carrier unit 35. Further, following increasing of the thickness of the stack of interfolded web products 22 on the holder 29, the holder 29 is lowered along the first direction X, as shown in FIG. 4G. In another embodiment of the present invention, the web product folding and stacking machine 20 eliminates the aforesaid second carrier unit 35 an uses the holder 29 to receive the finished stack of interfolded web products 22 from the first carrier unit 25 directly.

In actual application, the folding line making rolls 21 and the folding fingers 23 can be operated to fold and stack web products 22 on the second carrier unit 35 and to let the stack of interfolded web products 22 be placed on the holder 29. Thus, the folding line making rolls 21 and the folding fingers 23 will fold up web products 22 on the holder 29 by means of continuously repeating the steps of FIGS. 4A-4G.

Further, the folding fingers 23, the first carrier unit 25, a stoppage unit 27 and/or the second carrier unit 35 can be finger shape, and can be alternatively arranged at different elevations, facilitating folding, stacking, separation and/or delivery of web products 22.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A web product folding and stacking machine, comprising:

two folding line making rolls arranged in proximity to each other for transferring web products and causing each said web product to form a folding line thereon;

two folding fingers adapted to fold up each said web products along the folding line thereof for enabling said web products to be stacked up in an interfolded condition;

a first carrier unit, said first carrier unit having a top surface and a bottom surface opposite to said top surface;

a pad arranged on the top surface of said first carrier unit for carrying said web product for folding by said folding fingers;

a stoppage unit adapted to isolate interfolded web products, said stoppage unit being movable in a first direction; and a holder adapted to hold interfolded web products, said holder being movable in said first direction, wherein said first carrier unit has a suction device mounted therein for sucking one said web product, said suction device having a nozzle hole located on the bottom surface of said first carrier unit.

2. The web product folding and stacking machine as claimed in claim 1, further comprising a first folding unit and a second folding unit for folding up said web product suspending from said first carrier unit.

3. The web product folding and stacking machine as claimed in claim 2, wherein said first folding unit and said second folding unit are movable in a second direction perpendicular to said first direction.

4. The web product folding and stacking machine as claimed in claim 1, further comprising a second carrier unit adapted for receiving the interfolded web product from said first carrier unit.

5. The web product folding and stacking machine as claimed in claim 4, wherein said holder is adapted for holding the interfolded web products from said second carrier unit.

6. The web product folding and stacking machine as claimed in claim 4, wherein said second carrier unit is movable along a second direction perpendicular to said first direction.

7. The web product folding and stacking machine as claimed in claim 1, further comprising a conveyer adapted for delivering the interfolded web products from said stoppage unit and said holder.

8. The web product folding and stacking machine as claimed in claim 1, wherein said pad is elastic.

9. The web product folding and stacking machine as claimed in claim 1, wherein said holder is adapted to hold the interfolded web products from said first carrier unit.

10. A web product folding and stacking machine, comprising:

two folding line making rolls arranged in proximity to each other for transferring web products and causing each said web product to form a folding line thereon;

two folding fingers adapted to fold up each said web products along the folding line thereof for enabling said web products to be stacked up in an interfolded condition;

a first carrier unit adapted to carry said web product folded by said folding fingers;

a suction device installed in said first carrier unit and adapted to suck said web product suspending from said first carrier unit;

a stoppage unit adapted to isolate interfolded web products, said stoppage unit being movable in a first direction; and a holder adapted to hold interfolded web products, said holder being movable in said first direction.

11. The web product folding and stacking machine as claimed in claim 10, further comprising a first folding unit and a second folding unit operable to fold up said web product suspending from said first carrier unit.

12. The web product folding and stacking machine as claimed in claim 11, wherein said first folding unit and said second folding unit are movable in a second direction perpendicular to said first direction.

13. The web product folding and stacking machine as claimed in claim 10, further comprising a second carrier unit adapted for receiving the interfolded web product from said first carrier unit.

14. The web product folding and stacking machine as claimed in claim 13, wherein said holder is adapted for holding the interfolded web products from said second carrier unit.

15. The web product folding and stacking machine as claimed in claim 13, wherein said second carrier unit is movable along a second direction perpendicular to said first direction.

16. The web product folding and stacking machine as claimed in claim 10, further comprising a conveyer adapted for delivering the interfolded web products from said stoppage unit and said holder.

17. The web product folding and stacking machine as claimed in claim 10, wherein said holder is adapted for holding the interfolded web products from said first carrier unit.

18. A web product folding and stacking method used in the web product folding and stacking machine as claimed in claim 10, comprising the steps of:

forming a folding line on each of a plurality of web products and folding each said web product on said first carrier unit immediately after formation of the folding line;

operating said suction device to suck said web product suspending from said first carrier unit;

operating said stoppage unit to isolate interfolded web products when the number of the interfolded web products reaches a predetermined quantity; and moving said stoppage unit and said holder and the interfolded web products held thereon to a predetermined location.

19. The web product folding and stacking method as claimed in claim 18, further comprising a sub-step of operating a first folding unit and a second folding unit to fold up said web product suspending from said first carrier unit.

20. The web product folding and stacking method as claimed in claim 18, further comprising a sub-step of using said holder to receive the web products being folded on said first carrier unit.

21. The web product folding and stacking method as claimed in claim 18, further comprising a first sub-step of using a second carrier unit to receive a stack of interfolded web products from said first carrier unit and a second sub-step of using said holder to receive the stack of interfolded web products from said second carrier unit.

* * * * *